US009259833B2

(12) United States Patent
Bonini et al.

(10) Patent No.: US 9,259,833 B2
(45) Date of Patent: Feb. 16, 2016

(54) EXTENSIBLE BAR HANDLE

(71) Applicant: I.R.S. S.P.A., Campagnola Emilia (RE) (IT)

(72) Inventors: Emiliano Bonini, Novellara (IT); Simone Bonini, Campagnola (IT)

(73) Assignee: I.R.S. S.P.A., Campagnola Emilia (RE) (IT)

( * ) Notice: Subject to any disclaimer, the term of this patent is extended or adjusted under 35 U.S.C. 154(b) by 0 days.

(21) Appl. No.: 14/553,649

(22) Filed: Nov. 25, 2014

(65) Prior Publication Data

US 2015/0151425 A1 Jun. 4, 2015

(30) Foreign Application Priority Data

Nov. 29, 2013 (IT) ..... RE2013A0089

(51) Int. Cl.

| | |
|---|---|
| ***B25G 1/04*** | (2006.01) |
| ***E06B 9/42*** | (2006.01) |
| ***E06B 9/52*** | (2006.01) |
| ***E06B 9/54*** | (2006.01) |
| ***E06B 9/58*** | (2006.01) |
| *E06B 9/60* | (2006.01) |
| *E06B 9/24* | (2006.01) |
| *E06B 9/40* | (2006.01) |

(52) U.S. Cl.

CPC ... *B25G 1/04* (2013.01); *E06B 9/42* (2013.01); *E06B 9/522* (2013.01); *E06B 9/54* (2013.01); *E06B 9/58* (2013.01); *E06B 9/60* (2013.01); *E06B 2009/2458* (2013.01); *E06B 2009/402* (2013.01); *E06B 2009/405* (2013.01); *E06B 2009/524* (2013.01); *Y10T 16/473* (2015.01)

(58) Field of Classification Search

CPC ..... E06B 9/54; E06B 9/78; B25G 1/04
USPC ..... 160/31, 23.1, 39, 240, 263
See application file for complete search history.

(56) References Cited

U.S. PATENT DOCUMENTS

| | | | | |
|---|---|---|---|---|
| 998,102 | A * | 7/1911 | Ladwig et al. | 160/25 |
| 1,363,746 | A * | 12/1920 | Nossek | 160/263 |
| 1,780,556 | A | 11/1930 | Kallin et al. | |

(Continued)

FOREIGN PATENT DOCUMENTS

| | | |
|---|---|---|
| DE | 19549035 A1 | 7/1997 |
| DE | 202013002159 U1 | 3/2013 |

(Continued)

OTHER PUBLICATIONS

Machine translation of DE 202013002159.*

*Primary Examiner* — Katherine Mitchell
*Assistant Examiner* — Scott Denion
(74) *Attorney, Agent, or Firm* — Volpe and Koenig, P.C.

(57) ABSTRACT

An embodiment of the present invention relates to an extensible bar handle (205) for flexible screens (110, 115), comprising a tubular body (210) in which at least an extractable rod (215) is slidably inserted, which extractable rod (215) exhibits a head portion (230) projecting from one of the axial ends of the tubular body (210) and a draught-excluding brush (255) having a linear development and being fixed to the head portion (230) of the extractable rod (215), which is arranged parallel and flanked to a further draught-excluding brush (270) having a linear extension which is externally and longitudinally fixed to the tubular body (210).

12 Claims, 8 Drawing Sheets

(56) References Cited

U.S. PATENT DOCUMENTS

| | | | | |
|---|---|---|---|---|
| 2,316,027 | A * | 4/1943 | Swormstedt | 160/21 |
| 2,350,235 | A * | 5/1944 | Johnson | 160/387 |
| 2,486,568 | A * | 11/1949 | Lukaszevig | 160/25 |
| 2,498,094 | A * | 2/1950 | Plaum | 160/29 |
| 6,460,593 | B1 * | 10/2002 | Floyd | 160/370.22 |
| 7,621,313 | B2 * | 11/2009 | Pham | 160/250 |
| 2007/0012408 | A1 | 1/2007 | Cheng | |
| 2007/0068638 | A1 * | 3/2007 | Puskarz et al. | 160/370.22 |
| 2012/0152471 | A1 * | 6/2012 | Zernach et al. | 160/323.1 |

FOREIGN PATENT DOCUMENTS

| | | | |
|---|---|---|---|
| EP | 0870896 | A1 | 10/1998 |
| GB | 701430 | A | 12/1953 |

* cited by examiner

EXTENSIBLE BAR HANDLE

FIELD OF THE INVENTION

The present invention relates in general to screening devices for openings, for example for windows or French windows. In particular, the invention relates to screening devices having flexible screens, such as for example roller-windable mosquito nets.

BACKGROUND

As is known, roller nets essentially comprise a screen netting having a substantially rectangular shape, a terminal edge of which is fixed on a winding roller.

The winding roller is normally housed internally of a box structure which is fixed to a side of the window or the French window on which the mosquito net is applied.

The opposite terminal edge of the screen net is fixed to a bar handle, ends of which are slidably coupled to guide profiles fixed along two opposite sides of the window.

The bar handle can be translated manually distancingly from the winding roller so as to unwind and stretch the screen net on the lie plane of the window or French window.

For the mosquito net to be operative, the bar handle generally comprises hooking means which enable it to be fixed to an profiled abutment, which is anchored to the side of the window opposite the side bearing the containing structure of the winding roller.

When the presence of the mosquito net is not required and/or the passage through the window or the French window is to be used, the bar handle can be disengaged from the respective abutting profiled element in order to enable rewinding of the screen net onto the winding roller by appropriate elastic means loaded in the previous net-winding step.

Naturally, so as to prevent the undesired passage of insects through the window or French window, in the use position thereof the mosquito net must entirely occupy the passage gap and therefore must be correctly adapted to the jamb and architrave, i.e. it must be correctly sized for the window or French window to which it is fixed.

Unfortunately, as windows or French windows can be of all shapes and sizes, the mosquito net has to be specially made with suitable dimensions for the corresponding window or French window it is destined for.

Usually the task of predisposing the mosquito net with the proper measurements for the window or French window is trusted to an expert who adapts the net as required during the mounting step.

On the one hand this leads to higher costs because of the need to call an expert to adapt the mosquito net to the dimensions of the window it is destined for.

With the aim of reducing these drawbacks the industry of the sector produces mosquito nets of various standard sizes, so as to be ready for fixing.

However, the various dimensions available can cover all the really necessary sizes, especially in old buildings in which the measurements of the windows are not unified.

There are also the logistical and storage complications due to the different sizes of a same mosquito net model that have to be stored.

SUMMARY

To obviate these drawbacks an adaptable mosquito net has been developed, i.e. one that can be adapted for application to windows having both vertical and horizontal measurements comprised in a broad range, for example 20 cm, without any need for specialized technicians.

The mosquito net generally comprises two screening nets having a substantially rectangular development, each of which exhibits a terminal edge associated to a respective winding roller.

The two winding rollers are arranged parallel and superposed internally of a telescopic structure, which results in an extensible casing made of a series of box bodies which are slidably inserted in one another, so that the length of the telescopic structure can be adapted to the size of a side of the window or the French window.

The winding rollers are respectively constrained to the two box bodies located at the ends of the extensible casing, in such a way as to move reciprocally in an axial direction following a variation in length of the box structure, enabling the two screening nets to slide one on another and increasing or reducing the overall surface of the screening.

On the opposite side with respect to the winding rollers, the free terminal edges of the screening nets are associated to a bar handle, so as to be able to adapt to the dimensions of the overall surface of the nets.

In particular, the bar handle comprises a pair of extractable arms, which are slidably inserted at the opposite ends of a central tubular body, so that the projecting portions thereof can be slidably coupled to two guide profiled members fixed on the sides of the opening of the window or French window.

To guarantee the perfect screening of the opening of the window or the French window, use is included of a draught-excluding brush having a linear development, typically straight, which is fixed on the external surface of the bar handle, on the opposite side with respect to the screen, so as to be able to rest on the side of the window opposite the side bearing the telescopic containing structure of the winding rollers.

In the proposed embodiment, the length of this draught-excluding brush must be selected according to the specific dimensions of the window or French window.

This operation must be carried out on-site, after installation of the mosquito net, so as to be able to then apply the brush in an undercut gully fashioned in the bar handle.

Though simple, the mounting of the brush is thus a rather laborious operation which increases the installation time of the mosquito net and introduces potential defect types.

An aim of the present invention is therefore to obviate the above-mentioned drawback of the prior art, while being a simple, rational and relatively inexpensive solution.

This and other aims are attained by the characteristics of the invention as reported in the independent claims. The dependent claims delineate preferred and/or particularly advantageous aspects of the invention.

In particular, an embodiment of the present invention discloses an extensible bar handle for flexible screens, comprising a tubular body in which at least an extractable rod is slidably inserted, which extractable rod exhibits a head portion projecting from one of the axial ends of the tubular body, and a draught-excluding brush having a linear development and being fixed to the head portion of the extractable rod, which is arranged parallel and flanked to a further draught-excluding brush having a linear extension which is externally and longitudinally fixed to the tubular body.

With this solution, the two linear brushes fixed respectively to the head portion of the extractable rod and to the tubular portion together realize a single barrier, which can rest against an abutting surface so as to guarantee a perfect closing of the opening to which the windable screen is associated.

By varying the length of the bar handle, the two linear brushes further slide one on the other, varying the overall length of the barrier, automatically adapting it to the width of the opening to be screened. These brushes can further be fixed on the bar handle before it is installed, thus simplifying and making the mounting operations even easier for the installers.

In an aspect of the invention, the head portion of the extractable rod comprises at least an undercut groove in which a support rib of the draught-excluding brush is at least partially inserted.

In this way, the fixing of the brush is obtained by means of a very simple joint which also enables an easy replacement of the brush, should it wear out or get excessively dirty.

In particular, the groove can be defined by a plurality of hooks branching from the head portion of the extractable rod.

These hooks have the advantage of being realisable very simply, for example in a single body with the head portion of the extractable rod, thus reducing production costs.

In a further aspect of the invention, the opposite ends of a telescopic sleeve containing the projecting portion of the extractable rod can be fixed to the head portion of the extractable head and to the end of the tubular body.

The telescopic sleeve has the advantage of performing the double function of protecting the section of the extractable rod which projects into and from the tubular body and hiding it from view, thus improving the appearance and the overall aesthetic appeal of the whole bar handle.

In particular, the telescopic sleeve can comprise a plurality of tubular sections reciprocally inserted one in another, of which a more external section is fixed to the head portion of the extractable rod and a more internal section is fixed to the end of the tubular body.

With this solution, the telescopic sleeve is constructionally rather simple and can be easily integrated with the other components of the bar handle.

In an aspect of the embodiment, for example, the more external section of the telescopic sleeve comprises a projecting shelf which develops parallel to the extractable rod on the opposite side with respect to the head portion, and which is slidably inserted in a longitudinal gully of the tubular body.

This projecting shelf has the advantage of visually connecting the more external section of the telescopic sleeve with the tubular body, as well as the advantage of making the coupling thereof more rigid and stable.

In a further aspect of this embodiment, the external section of the telescopic sleeve can also comprise an undercut groove in which the support rib of the draught-excluding brush is at least partially inserted.

The groove can preferably also extend along the above-mentioned projecting shelf.

With this solution, the draught-excluding brush is advantageously supported stably over a very extended section, potentially over all a length thereof, or almost.

In this case too, the groove can be defined by a plurality of hooks branching from the more external section of the telescopic sleeve.

In a further different aspect of the invention, the tubular body and the telescopic sleeve of the bar handle can be provided with contiguous openings forming a single longitudinal slit enabling insertion of an edge of the flexible screens.

The advantage of this solution consists in the fact of enabling fixing the windable screens to the bar handle, without there being any obstacle to the movements of lengthening or shortening thereof.

In a further aspect of the invention, the bar handle preferably also comprises a second extractable rod having the same characteristics as outlined above, a head portion of which projects from the other axial end of the tubular body.

In this way the length extension range of the bar handle is effectively handled, which further acquires a symmetrical conformation that is aesthetically more appealing.

In a further embodiment of the invention a screening device is provided, for example a mosquito net, which comprises:

a first and a second flexible screen;

a telescopic structure comprising a first box element and a second box element fixable oppositely on two sides of an opening;

a first winding roller and a second winding roller parallel to and bearing a first terminal edge respectively of the first flexible screen, the first and second rollers being rotatably coupled and axially constrained respectively to the first box element and the second box element; and a bar handle as in any one of the preceding claims, which bears a second terminal edge, opposite the first edge, respectively of the first flexible screen and the second flexible screen, the bar handle being translatable distancingly from and nearingly to the winding rollers.

This embodiment of the invention substantially attains the same advantages previously delineated, in particular the advantage of making the mounting of the whole device more rapid and simple, mainly thanks to the fact that the draught-excluding brushes are already integrated in the bar handle and are automatically adjusted.

In a further aspect of this embodiment of the invention, the head portion of each extractable rod of the bar handle can comprise a hooking element hookable to an end of the telescopic structure.

In this way, on installing the screening device, when an operator adjusts the length of the telescopic structure, adapting it to the width of the opening to be screened, the length of the bar handle is automatically adjusted in a very simple, functional and extremely rapid way.

In an aspect of this embodiment of the invention, the device can further comprise a pair of telescopic guide elements fixable along two opposite sides of the opening and arranged perpendicularly with respect to the telescopic structure, in which opposite ends of the bar handle slide.

Thanks to this solution, the device can be adjusted according to the dimensions of the opening to be screened not only in the direction of the bar handle but also in a perpendicular direction.

BRIEF DESCRIPTION OF THE DRAWINGS

Further characteristics and advantages of the invention will emerge from a reading of the description that follows, provided by way of non-limiting example, with the aid of the figures of the accompanying tables.

DETAILED DESCRIPTION OF THE PREFERRED EMBODIMENTS

Figure 1:
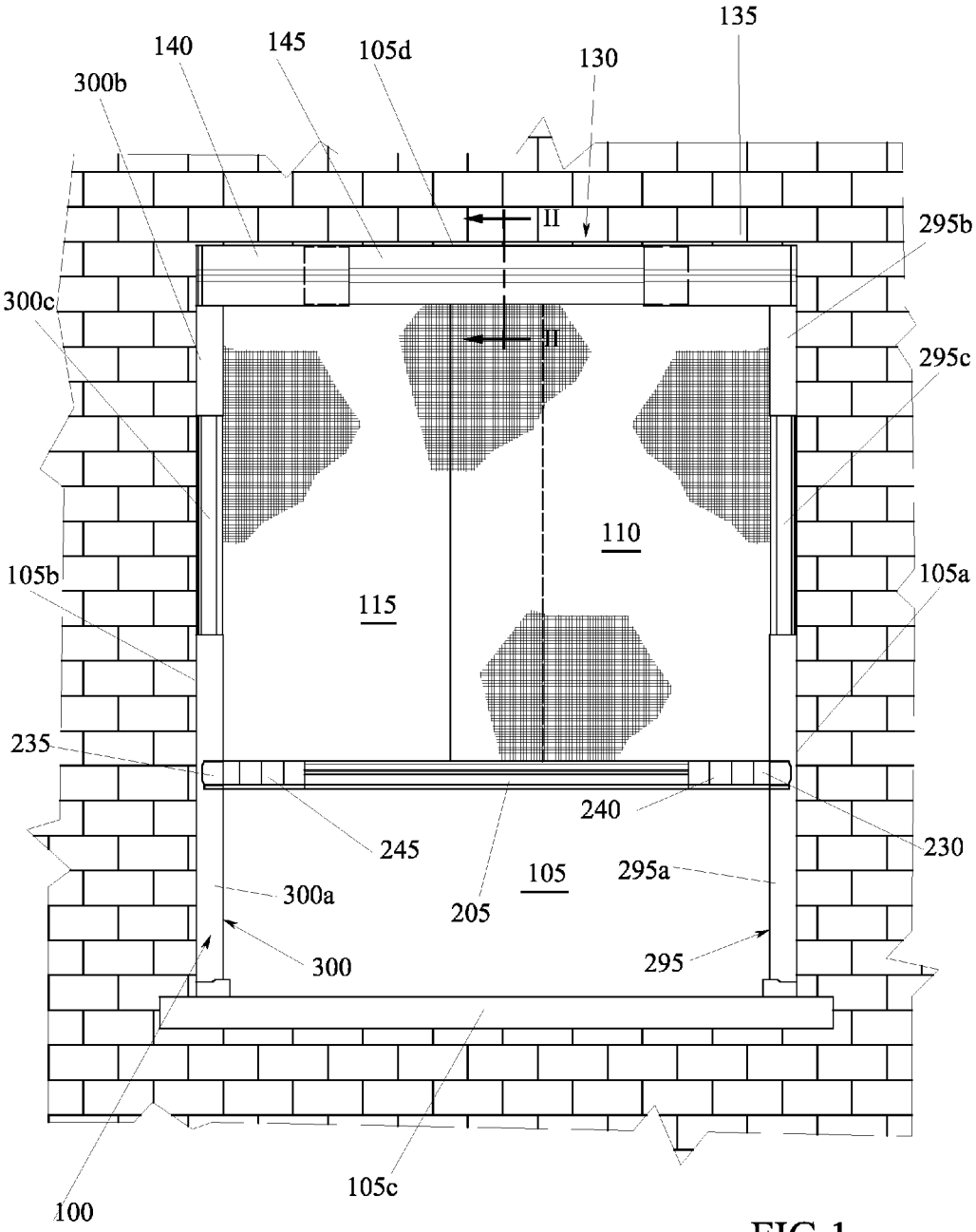
FIG. 1 is a front view of a mosquito net according to an embodiment of the present invention, applied to a window.

The figures relate to a mosquito net 100, for screening a passage opening 105 of a window or French-window, where the opening 105 exhibits a substantially rectangular shape having a first and a second vertical side 105*a* and 105*b*, a lower horizontal side 105*c* and an upper horizontal side 105*d* (FIG. 1).

The mosquito net 100 comprises a first net screen 110 and a second net screen 115, which are usually made of a synthetic material, or aluminium or stainless steel.

The screens 110 and 115 can exhibit, for example, a squared mesh width of between 0.2 and 2 mm, so as to provide an effective barrier against passage of small insects such as mosquitoes, while ensuring an efficient permeability to air.

The screens 110 and 115 both have a substantially rectangular and each exhibit a first end edge 116 (FIG. 2) fixed respectively to a first winding roller 120 and a second winding roller 125.

In the illustrated example, the first end edge 116 of each screen 110 and 115 is jointed in a groove 120*a* and 125*a* formed on the respective winding roller 120 and 125 and is extended parallel to the rotation axis thereof.

The rollers of the collection 120 and 125 are parallel and flanked to one another, in the present case being superimposed, and are both contained within a telescopic structure 130 that can be made of an aluminium alloy and which can be fixed in parallel order along one of the sides of the opening 105 to be screened, usually the upper side 105*d*.

Figure 3:
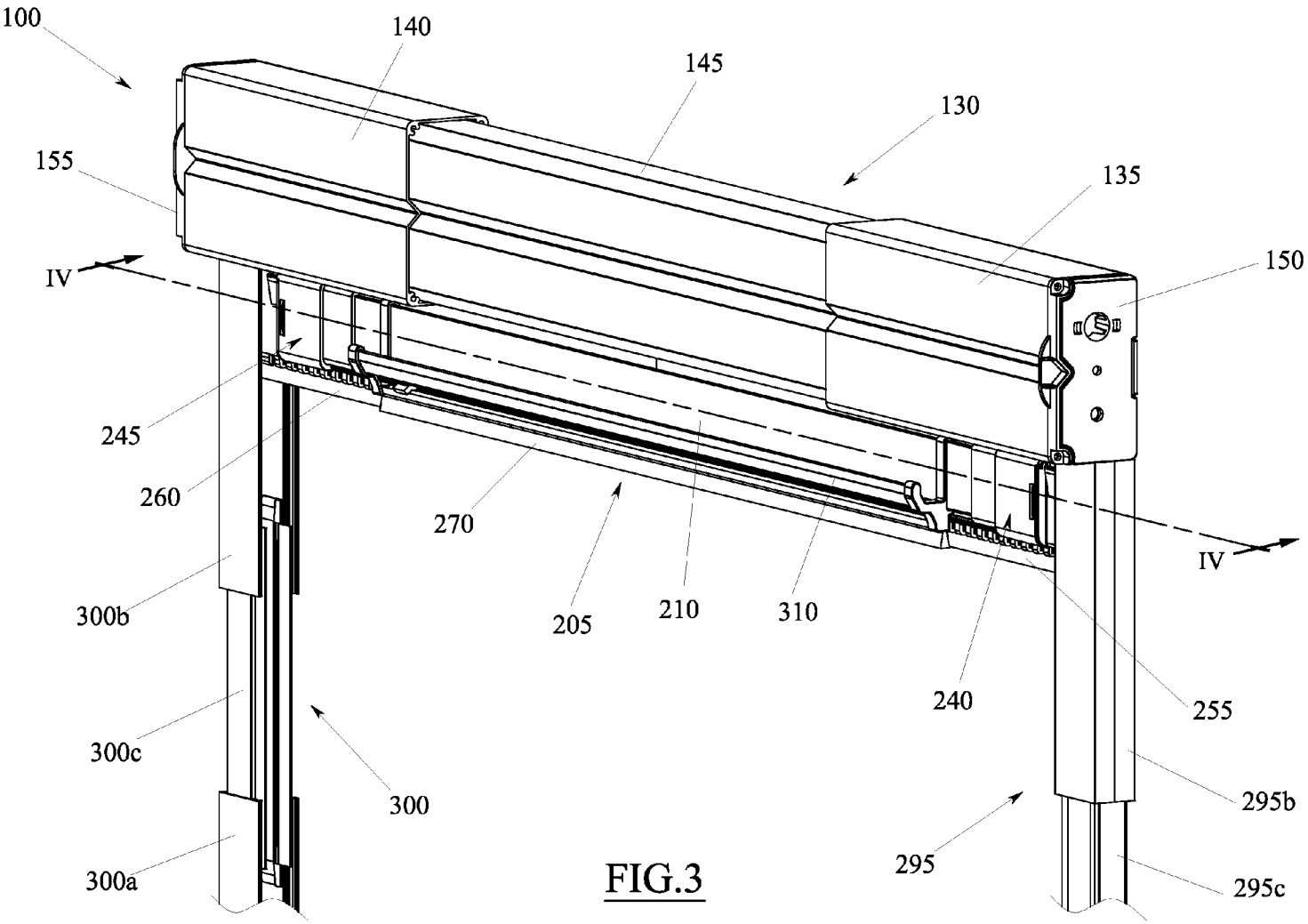
FIG. 3 is an isometric view of the mosquito net of FIG. 1, demounted and shown partially.
Figures 4, 5:
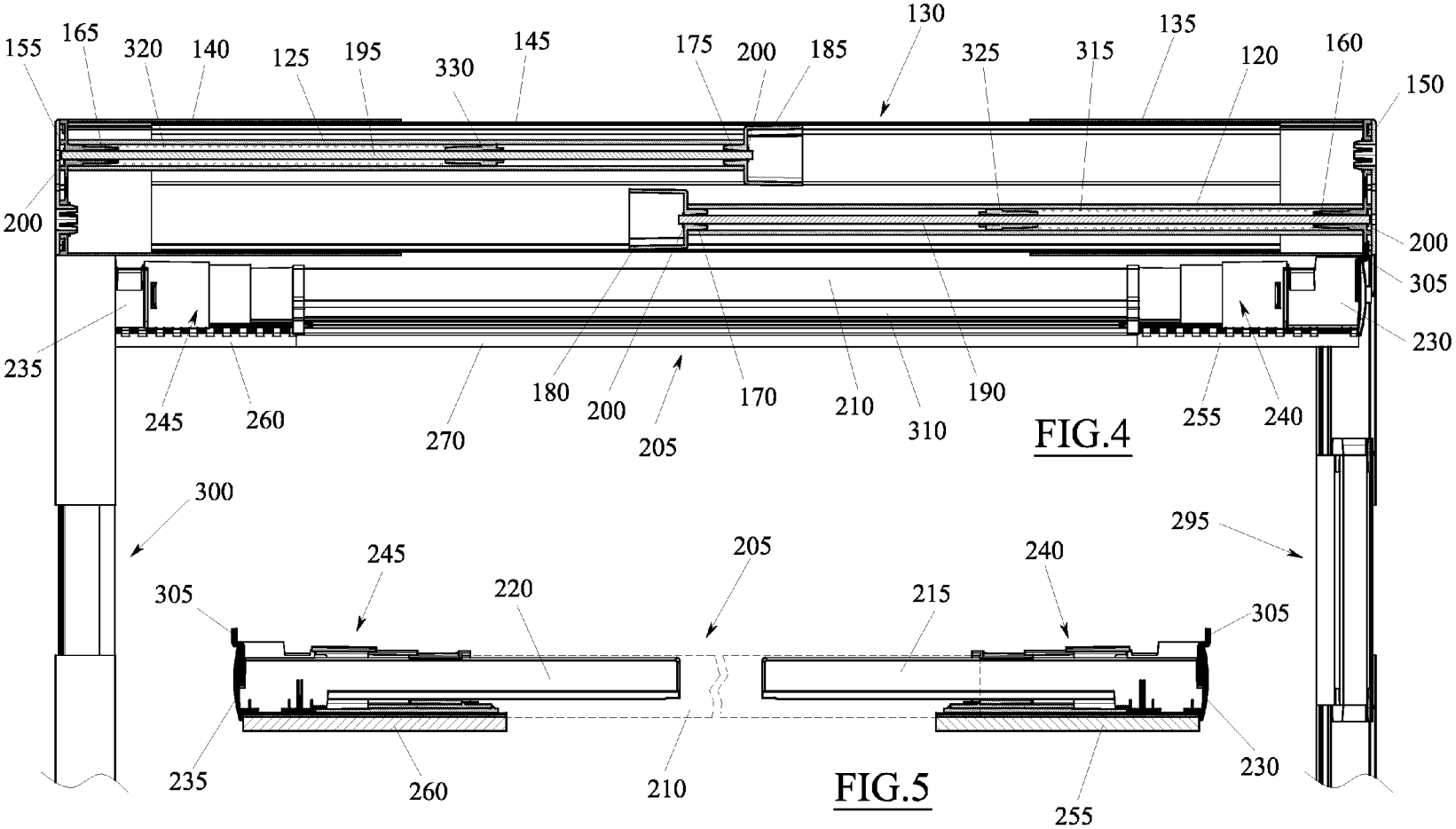
FIG. 4 is a front view of the mosquito net, in which the upper telescopic structure and the right lateral guide have been sectioned along plane IV-IV indicated in FIG. 3, and in which the nets have been omitted for the sake of clarity.
FIG. 5 is a section of the bar handle of the mosquito net of FIG. 4, made along plane IV-IV of FIG. 3 and wherein the central tubular element is shown only schematically in a broken line.
Figure 6:
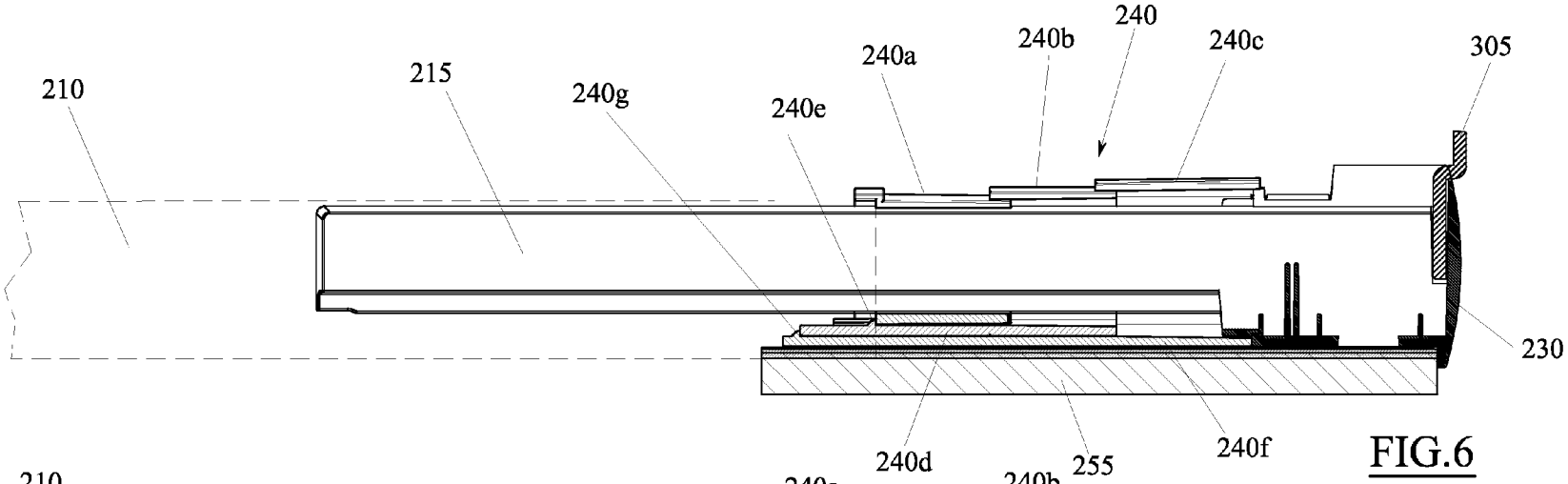
FIGS. 6 and 7 are detailed views of one of the extractable rods illustrated in FIG. 5, respectively in an extracted position and a retracted position.

As illustrated in FIGS. 3 and 4, the telescopic structure 130 includes a first box element 135 and to a second box element 140, which are inserted at opposite ends of an intermediate third box element 145, in such a way that they are both able to slide with respect to the third intermediate element 145, thus increasing or reducing the overall length of the telescopic structure 130.

The winding rollers 120 and 125 are oriented parallel to the lengthening/shortening axis of the telescopic structure 130 and are associated, constrained axially but freely rotating about the central axes thereof, respectively to the first box element 135 and second box element 140.

In particular, the mounting of the rollers of the collection 120 and 125 is achieved by using a pair of heads 150 and 155 which are fixed to the free ends of the respective box elements 135 and 140.

Each head 150 and 155 is provided with a first hollow pin 160 and 165 on which first one end of each winding roller 120 and 125 is coaxially and rotatably inserted, the winding rollers 120 and 125 in this case having a cylindrical internally hollow shape.

The opposite end of each winding roller 120 and 125 is coaxially and rotatably inserted on a second hollow pin 170 and 175 formed on a respective sliding block 180 and 185.

Each winding roller 120 and 125 is axially constrained to the respective box element 135 and 140 by means of a rigid shaft 190 and 195 which passes coaxially internally of the first hollow pin 160 and 165, internally of the winding roller 120 and 125, and internally of the second hollow pin 170 and 175, the ends of which rigid shaft 190, 195 are axially blocked to the head 150 and 155 and to the sliding block 180 and 185 by means of spring washers 200.

This enables the winding rollers 120 and 125 to freely rotate about the central axes thereof and to be constrained in the axial excursions thereof to the respective box elements 135 and 140.

In substance, when one of the box elements 135 and 140 is displaced along a parallel direction to the axes of the winding rollers 120 and 125, it draws the whole group along with it between the two spring washers 200.

In this way, by sliding the box elements 135 and 140 along the direction parallel to the axes of the winding rollers 120 and 125, it is advantageously possible to adapt the length of the telescopic structure 130 to the length of the upper side 105*d* of the opening 105. In other words, the box elements 135 and 140 can slide on the intermediate element 145 between a narrowed position, in which they are neared to one another, and an extended position, in which they are mutually distanced, so as to obtain the desired length.

In the example, the size range obtainable is approximately 20 cm, suitable for making the mosquito net 100 usable for a plurality of windows having varying widths within the available range of 20 cm.

Since the winding rollers 120 and 125 are contained in the telescopic structure 130, the box elements 135 and 140 and the intermediate element 145 are provided with respective contiguous openings forming an overall single slit 202 (FIG. 2), which is extended parallel to the axes of the rollers of the collection 120 and 125 to enable passage of the screens 110 and 115.

In the part projecting from the telescopic structure 130, the screens 110 and 115 have a respective second end edge 117 (visible only in FIGS. 8 and 9 for the first net 110), which is opposite the first end edge 116 and is associated to a bar handle 205 which extends parallel to the telescopic structure 130, is movable in a transversal direction to the structure 130 and is extensible in the axial direction.

In particular, the bar handle 205 comprises a central tubular body 210 at the opposite ends of which two extractable rods 215 and 220 are axially inserted (FIG. 5).

Figure 8:
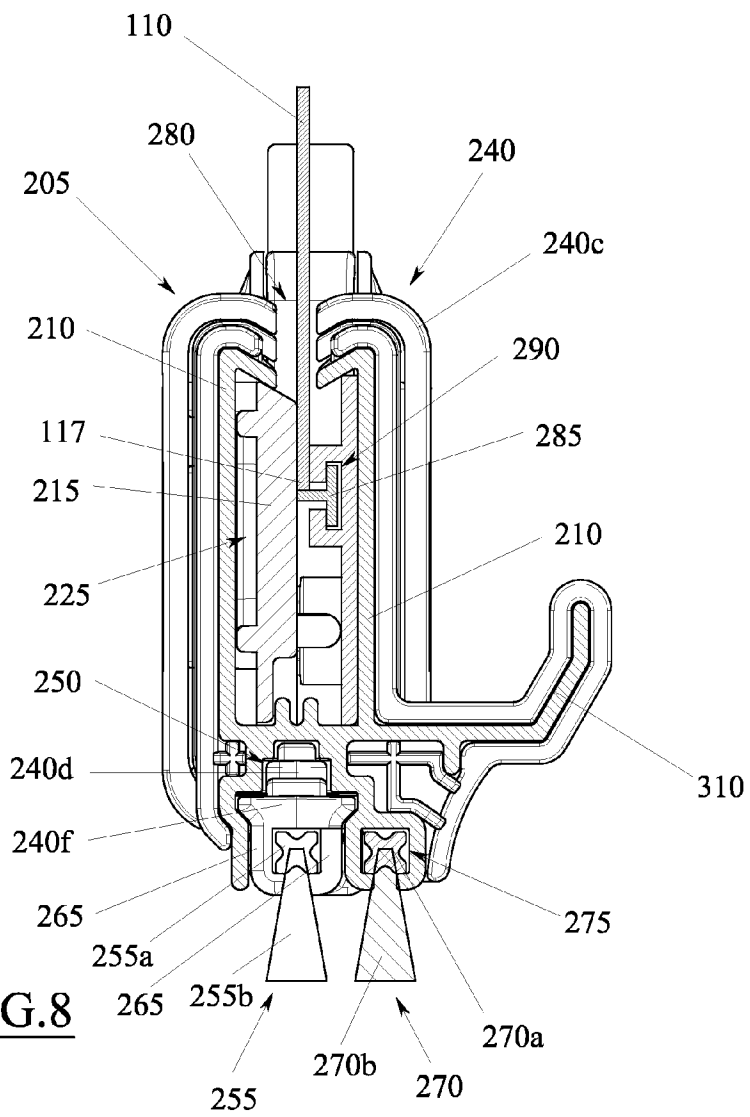
FIG. 8 is section VIII-VIII of FIG. 7.

In the example, the central tubular body 210 is fashioned from a profiled member of substantially flat shape, which exhibits an axial cavity 225 shaped as a corridor extending longitudinally for the entire length of the profiled member (FIG. 8).

The two extractable rods are slidably inserted in the axial cavity 225, of which a first extractable rod 215 is provided with a head portion 230 projecting from an axial end of the central tubular body 210, while the second extractable rod 220 is provided with a head portion 235 projecting from the other axial end of the central tubular body 210 (FIG. 5).

Figure 10:
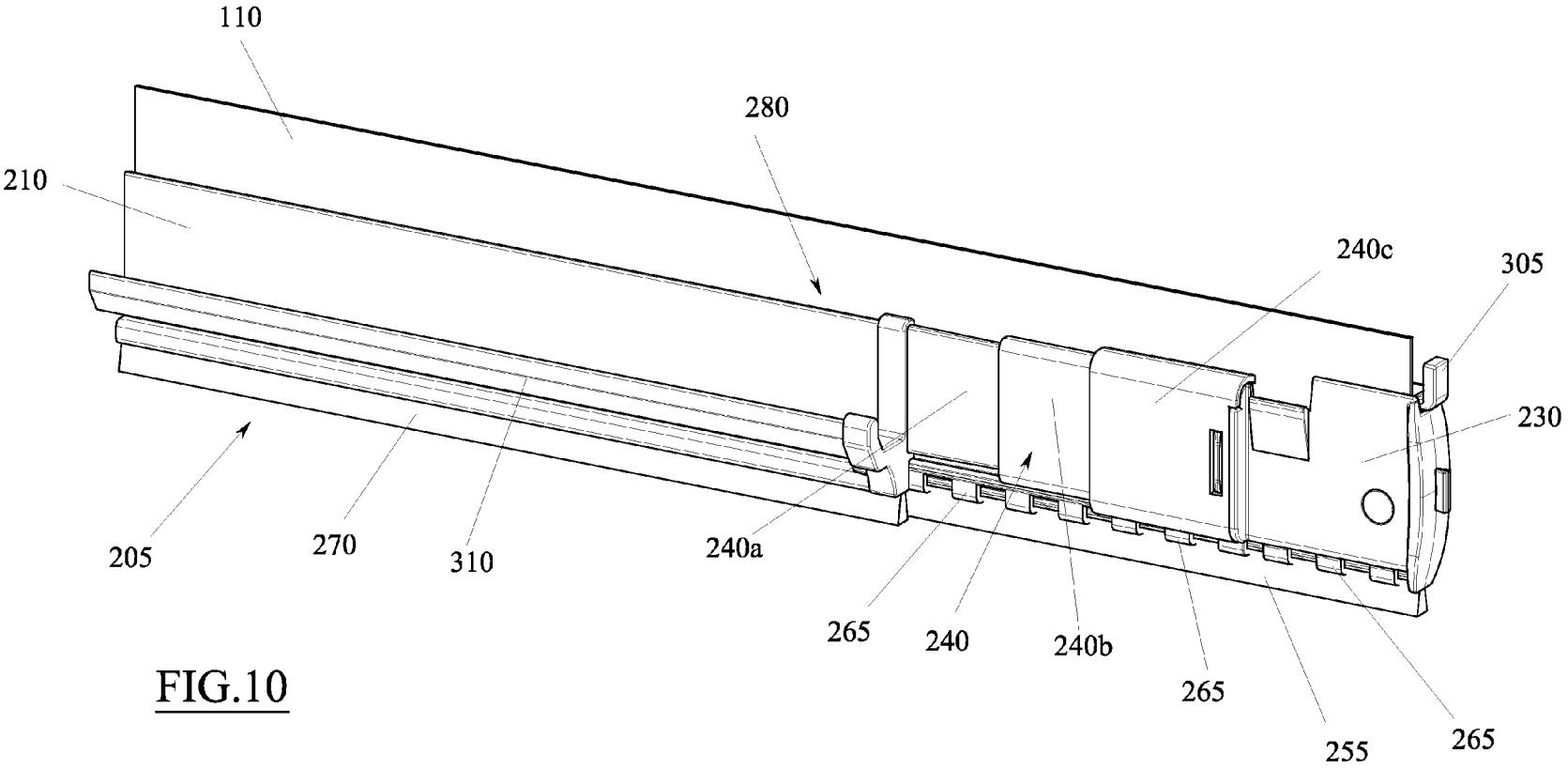
FIGS. 10 and 11 are two isometric views, respectively from above and from below, of the detail shown in FIG. 6.

In the example, the extractable rods 215 and 220 also have a substantially flat shape and the head portions 230 and 235 are conformed as sheaths having a complementary shape inserted at the ends of the respective extractable rod 215 and 220, with respect to which they exhibit lateral dimensions that are larger so as not to be able to slide into the central tube 210 (FIG. 10).

A respective telescopic sleeve 240 and 245 is interposed between each head portion 230, 235 and the end the central tubular 210 proximal thereto, which sleeve 240 and 245 coaxially contains and covers the projecting portion of the relative extractable rod 215 and 220.

The opposite ends of each telescopic sleeve 240 and 245 are fixed respectively to the head portion 230 and 235 of the extractable rod 215 and 220 and to the proximal end of the central tubular body 210, so that the telescopic sleeves 240 and 245 can extend and retract automatically, following the relative sliding of the extractable rods 215 and 220 with respect to the central tubular body 210.

In the example, the group formed by the extractable rods 215 and 220, by the head portions 230 and 235 thereof and by the relative telescopic sleeves 240 and 245 are identical to one another, so in the following a description will be provided only of the group headed on the extractable rod 215, its being understood that the same description can also be repeated for the other group.

As illustrated in FIGS. 6 to 10, the telescopic sleeve 240 comprises three tubular sections inserted in one another, of which an internal portion 240*a* directly fixed to the end of the central tubular body 210, an intermediate portion 240*b* inserted over the internal portion, and an external portion inserted on the intermediate portion 240*c* and fixed directly to the head portion 230 of the extractable rod 215.

The fixing of the internal portion 240*a* on the central tubular 210, as well as the attachment of the external portion 240*c* on the head portion 230, can be achieved by interlocking means or by gluing or by any other suitable means. The intermediate portion 240*b* exhibits a narrow and long projecting shelf 240 cantilevered from the end opposite the head portion 230, developing parallel to the extractable rod 215 towards the end of the central tubular element 210.

The projecting shelf 240*d* extends beyond the internal portion 240*a* and inserts into a longitudinal channel 250 fashioned over the whole length of the central tubular element 210, where it is parallel to and separate from the cavity 225 (FIG. 8).

At the free end thereof, the projecting shelf 240*d* bears a tooth 240*e* that is distant from the edge of the internal portion 240*a*, but that can interfere with the internal portion 240*a* when the intermediate portion 240*b* is in the extracted position.

In this way, the run of the intermediate portion 240*b* with respect to the internal portion 240*a* is limited, on the one side, by the edge of the central tubular element 210 and, on the opposite side, by the tooth 240*e* which contacts the edge of the internal portion 240.

Likewise, the external portion 240*c* has a has a narrow and long projecting shelf 240*f* projecting from the opposite end with respect to the head portion 230, developing parallel to the extractable shaft 215 towards the central tubular element 210, substantially flanked to and in contact below the projecting shelf 240*d* of the intermediate section 240*b*.

The projecting shelf 240*f* extends beyond the intermediate portion 240*b*, the internal portion 240*a* and the projecting shelf 240*d*, so as also to insert internally of the longitudinal channel 250.

At the free end thereof, the projecting shelf 240*f* bears a tooth 240*g* that is distant from the edge of the projecting shelf 240*d*, but that can interfere with the projecting shelf 240*d* when the external portion 240*c* is in the extracted position.

In this way, the run of the external portion 240*c* with respect to the intermediate portion 240*b* is limited, on the one side, by the head portion 230 and, on the opposite side, by the tooth 240*g* which contacts the free edge of the shelf 240*d*.

The bar handle 205 further comprises two draught-excluding brushes 255 and 260 having a linear development, in this case straight, each of which is fixed to the head portion 230 and 235 of the relative extractable rod 215 and 220 and extends parallel thereto.

In the example, the draught-excluding brushes 255 and 260 are also identical to one another and fixed to the relative extractable rods in the same way, for which reason only the brush 255 will be described in the following, as the same description can be repeated for the other brush 260 too.

Figure 9:
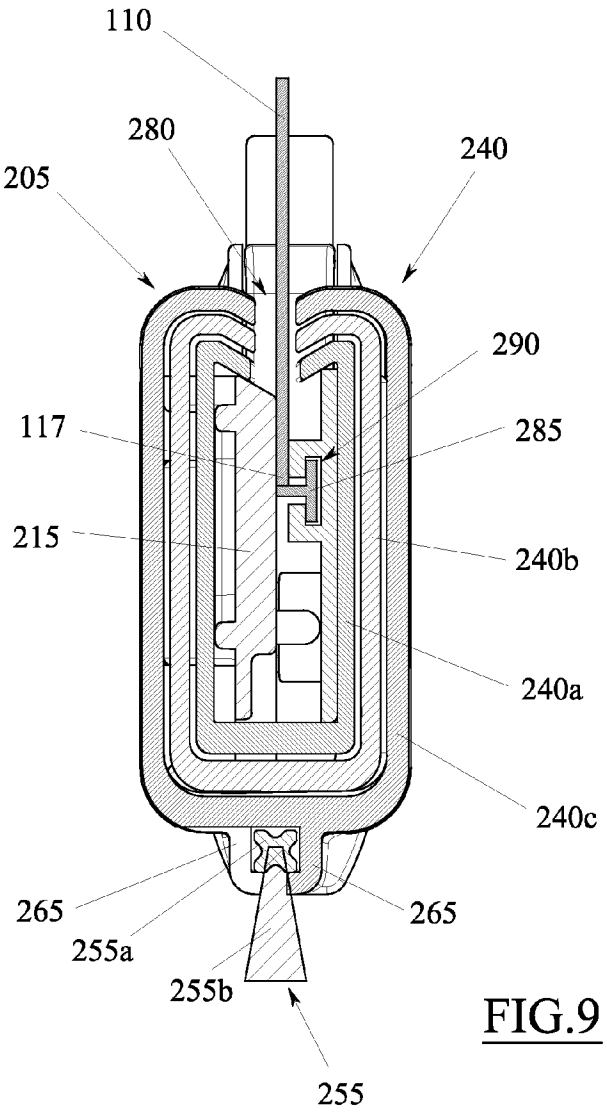
FIG. 9 is section IX-IX of FIG. 7.

As illustrated in FIG. 9, the draught-excluding brush 255 generally comprises a support rib 255*a* having a linear development and a plurality of bristles 255*b* fixed on a side of the support rib 255*a*, so as to form a continuous wall.

In the example, the draught-excluding brush 255 is supported by a plurality of opposite pairs of hooks 265, which branch from the head portion 230, as well as from the external portion 240*c* and from the projecting shelf 240*f* of the telescopic sleeve 240 (FIG. 10).

These pairs of hooks 265 are arranged in succession and are mutually spaced apart, so as to define a generally longitudinal groove in undercut in which the support rib 255*a* of the brush 255 is inserted, so that the bristles 255*b* thereof can project inferiorly with respect both to the hooks 265 and to the longitudinal channel 250 of the central tubular element 210, thus remaining always exposed to the outside of the lower surface of the bar handle 205.

Figure 7:
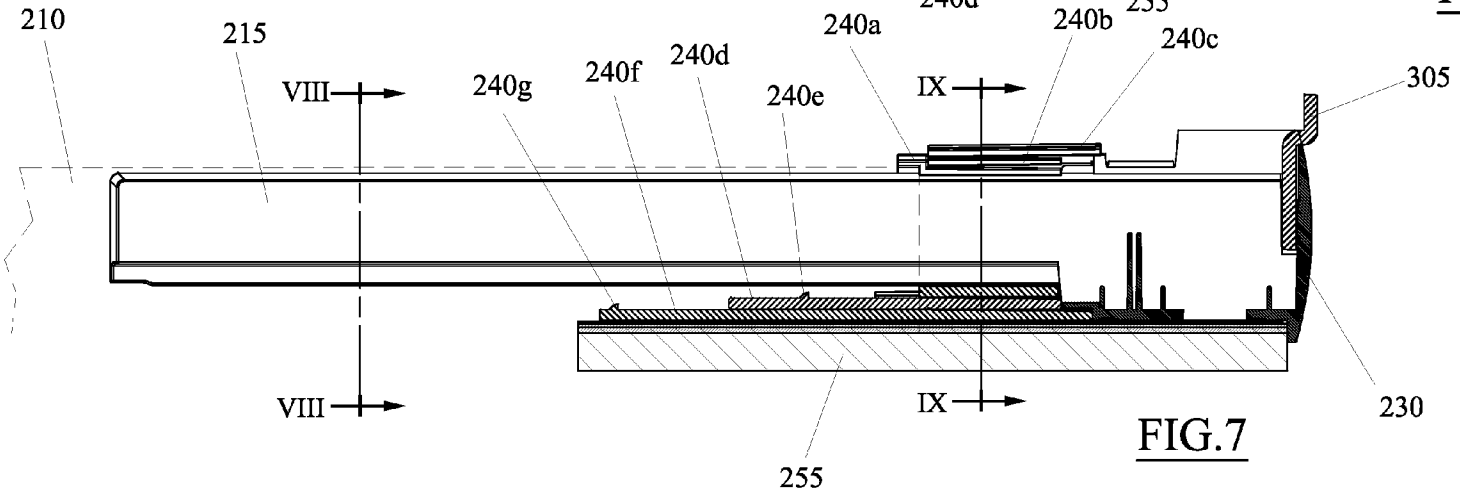

The draught-excluding brush 255 extends from the end of the head portion 230, passing under the projecting shelf 240*f*, up to inserting in the longitudinal channel 250 of the central tubular element 210 (FIGS. 7 and 8).

The bar handle 205 also comprises a third draught-excluding brush 270, alike to the preceding, which is stably fixed to the central tube 210, where it develops parallel to but is slightly offset with respect to the brushes 255 and 260, which are arranged substantially aligned between them in the axial direction (FIG. 5).

In particular, the third draught-excluding brush 270 extends substantially entirely along the length of the central tube 210 and includes a support rib 270*a* inserted into a groove 275 in undercut formed in the central tubular element 210, flanked to the longitudinal channel 250 in which the brushes 255 and 260 are partially inserted (FIG. 8).

The brush 270 also comprises a plurality of bristles 270*b*, fixed to the rib 270*a*, which project from the undercut groove 275, and are located substantially flanked and adjacent to the bristles of other brushes 255 and 260, forming with the other brushes 255 a single barrier developing over the entire length of the bar handle 205.

With this solution, following a relative sliding of the extractable rods 215 and 220 with respect to the central tubular element 210, the draught-excluding brushes 255, 260 and 270 slide on each other, without ever interrupting the continuity of the barrier, the length of which adapts automatically to the width of the opening 105.

In fact, the draught-excluding brush 270 has a length that is substantially equal to the length of the central tubular element 210, while the draught-excluding brushes 255 and 260, though having a shorter length than the brush 270, are longer than the distance separating the respective head portions 230 and 235 from the adjacent ends of the central tubular element 210 when the removable rods 215 and 220 are in the fully-extracted position.

Figure 11:
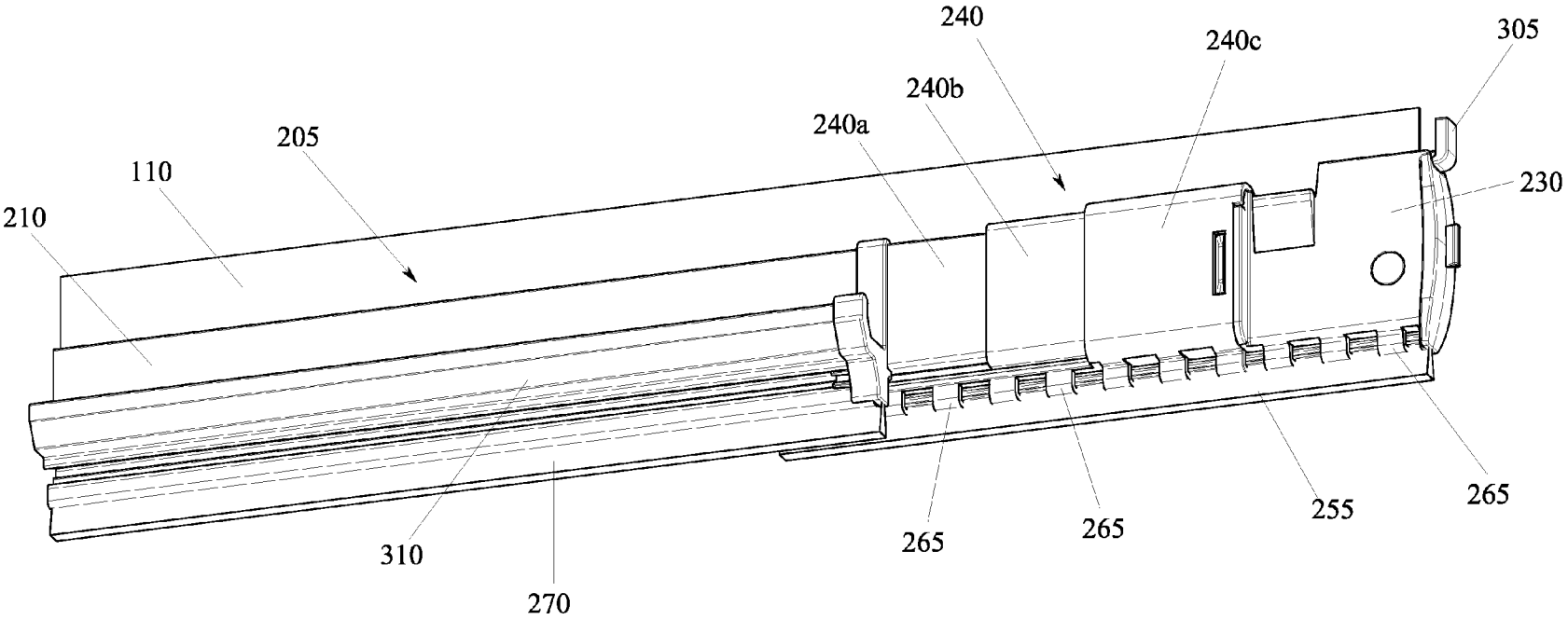

In this way, as visible in FIG. 11 for only the brush 255 (though the same also applies to the other brush), the draught-excluding brushes 255 and 260 are always at least partially overlapping the brush 270, even when the extractable rods 215 and 220 are in the fully extended position, and can approach one another, sliding on the brush 270, gradually as the extractable rods 215 and 220 are returned internally of the tubular body.

As the second end edges of the screens 110 and 115 are contained in the bar handle 205, the central tubular element 210, the telescopic sleeves 240 and 245, as well as the head portions 230 and 235, are provided with contiguous openings together forming a single slit 280 (FIGS. 8 and 9), extending parallel to the axes of the rollers 120 and 125 of collection so as to enable passage of the screens 110 and 115.

In particular, the second end edges 117 of the screens 110 and 115 are fixed to the bar handle 205 by means of a respective anchor rod 285, in the example made of a plastic material, which is fixed parallel to the terminal edge 117 of each screen 110 and 115 and is inserted in a gully 290 in undercut formed in a strip inserted internally of the telescopic sleeves 240 and 245 and the central tubular element 210.

The opposite ends of the bar handle 205, namely the head portions 230 and 235 of the rods 215 and 220, are slidably removably coupled to a respective guide element 295 and 300, which branch perpendicularly from opposite ends of the telescopic structure 130, so as to be attachable on opposite sides 105*a* and 105*b* of the opening 105 (FIG. 1).

In order to make the mosquito net 100 more versatile, the profiled lateral guide elements 295 and 300 are telescopic and each comprises a first element 295*a* and 300*a* and a second element 295*b* and 300*b* fixable along the two opposite sides 105*c* and 105*d* of the opening 105, and arranged perpendicularly with respect to the telescopic structure 130.

In the illustrated example, each first element 295*a* and 300*a* and each corresponding second element 295*b* and 300*b* are slidably inserted at opposite ends of a third element 295*c* and 300*c*, so as to be able to vary the length of the guide elements 295 and 300 up reaching a desired size.

In the example, the excursion practicable with the guide elements 295 and 300 can be between about 20 cm and about 60 cm, sufficient to adapt to a considerable plurality of height dimensions of common passage openings.

In this way, the bar handle 205 is translatable distancingly from and nearingly to the telescopic structure 130, simultaneously unrolling or rolling the two screens 110 and 115 from/onto the respective winding rollers 120 and 125.

The translation of the bar handle 205 can be done manually with the aid of a handle 310 formed or fixed externally in the central tubular element 210.

Figure 2:
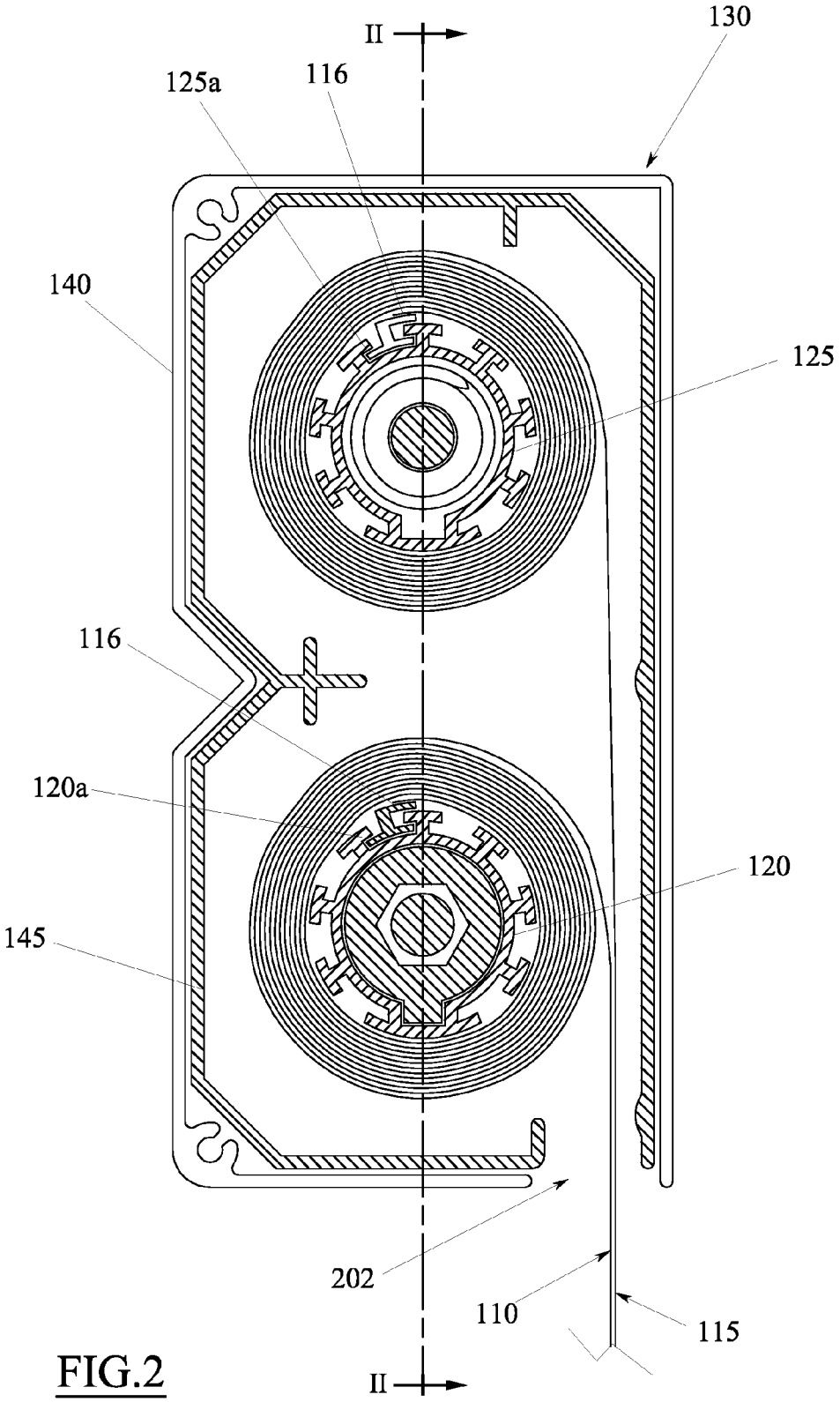
FIG. 2 is section II-II of FIG. 1 shown in larger scale.

In order to make the screens 110 and 115 effective against the entry of insects, when they are stretched out, the two winding rollers 120 and 125 are placed with their rotation axes lying on a single vertical plane, as shown in FIG. 2.

This, together with the appropriate sizing of the slit 202, enables a perfect adherence to be achieved between the two screens 110 and 115 in the mutual overlap area.

The perfect adherence in the overlap area between the two screens 110 and 115 can also be improved by using suitable means, such as an idler pulley (not illustrated), that cause the two nets to adhere before leaving the slit 202.

In order to enable automatic rewinding of the screens 110 and 115 elastic return means are generally used, associated respectively to the winding rollers 120 and 125.

In the example, the elastic return means comprise, for each winding roller 120 and 125, a flexure coil spring 315 and 320 coaxially inserted in the interspace between the respective winding roller 120 and 125 and the relative rigid shaft 190 and 195 (FIG. 4).

Each of the helical springs 315 and 320 is fixed, at an end thereof, to the head 150 and 155 of the corresponding box element 135 and 140, keyed unremovably on the hollow pin 160 or respectively 165, and is fixed at the other end thereof to the respective winding roller 120 and 125.

The fixing of the springs 315 and 320 to the respective winding rollers 120 and 125 is done using a pair of cylinders 325 and 330 (FIG. 4), each of which is unremovably fixed to the remaining end of the respective spring 315 and 320 and is constrained to the respective winding roller 120 and 125 by means of a sliding coupling.

Thanks to this solution, when the winding rollers 120 and 125 are rotated by effect of the translation of the bar handle 205, they also force the springs 315 and 320 to rotate about the same axis, with the exception of the portion of the spring located in the fixing point on the hollow pins 160 and 165, which instead is prevented from rotating.

In this way, as the bar handle 205 is gradually distanced from the telescopic structure 130, the screens 110 and 115 unroll and the springs 315 and 320 elastically load.

Consequently, on release of the bar handle 205, after having translated distancingly from the telescopic structure 130, there will be an immediate and automatic rewinding of the screens 110 and 115 onto the winding rollers 120 and 125.

To prevent an undesired rewinding, for example when the mosquito net 100 is in use, i.e. when the screens 110 and 115 are fully extended to close the opening 105, suitable stop means of known type are provided, which are able to lock the bar handle 205 at the bottom side 105*c* thereof.

In this configuration, the draught-excluding brushes 255, 260 and 270, which protrude from the bottom surface of the bar handle 205, are placed in contact with the bottom side 105*c*, with the aim of ensuring the perfect occlusion of the opening 105 of the window, preventing the passage of draughts of air and insects from possible interface gaps.

In an important aspect of the invention, prior to installation the above described mosquito net 100 is provided with the bar handle 205 in the raised position and placed substantially in contact with the telescopic structure 130, as shown in FIG. 4.

In this condition, the bar handle 205 is preferably provided with two profiled plates 305, which are respectively fixed to the two head portions 230 and 235 of the extractable rods 215 and 220 (see also FIG. 5).

The profiled plates 305 project from the upper surface of the bar handle 205 and each engage in a respective housing seating formed in the end caps 150 and 155 which close the ends of the box elements 135 and 140 forming the telescopic structure 130.

Upon installation, each extractable rod 215 and 220 of the bar handle 205 is then axially solidly constrained to a respective box element of the above-mentioned box elements 135 and 140.

In this way, when the box elements 135 and 140 are slid onto the intermediate element 145 to adjust the length of the telescopic structure 130 according to the width of the upper side 105*d* of the window, they draw with them also the extractable rods 215 and 220, thus resulting in the automatic adjustment of the length of the bar handle 205.

After the telescopic structure 130 and the bar handle 205 have been thus installed, the profiled lateral guide elements 295 and 300 are mounted, and the profiled plates 305 can finally be removed.

After having adjusted the length of the bar handle 205, the extractable rods 215 and 220 can be blocked in the position reached using appropriate blocking means. In an embodiment, the blocking means can comprise at least a screw, which can be positioned for example at the centre of the bar handle 205 and can engage to the extractable rods 215 and 220 and block them with respect to the central tubular element 210. In other embodiments, the blocking means can comprise magnetic means able to create a magnetic interaction between the head portions 230 and 235 of the extractable rods 215 and 220 and the respective profiled lateral guide elements 295 and 300, preferably over the whole length thereof.

Thanks to these blocking means it is ensured that the length of the bar handle 205 will remain constant, even where the window passage is not perfectly rectangular and/or where the mosquito net 100 is arranged horizontally instead of vertically as shown in the accompanying figures.

Obviously a person skilled in the art might make numerous modifications and variations to the mosquito net windable mosquito net described herein, with the aim of satisfying contingent and specific requirements, all falling within the scope of protection of the invention as it is defined in the following claims.

The invention claimed is:

1. An extensible bar handle (205) for flexible screens (110, 115), comprising:

a tubular body (210) having a first axial end and a second axial end;

an extractable rod (215) slidably engaged with the tubular body (210), said extractable rod (215) comprising a head portion (230) projecting from the first axial end of the tubular body (210);

a first draught-excluding brush (255) that extends in a linear direction and is fixed to the head portion (230) of the extractable rod (215);

a second draught-excluding brush (270) that extends in a linear direction and is externally and longitudinally fixed to the tubular body (210), wherein the first draught-excluding brush (225) is arranged parallel and flanked to the second draught-excluding brush (270); and a telescopic sleeve (240) having opposite ends that are fixed to the head portion (230) of the extractable rod (215) and to the first end of the tubular body (210), the telescopic sleeve (240) containing a projecting section of the extractable rod (215) that projects from the first axial end of the tubular body (210).

2. The bar handle (205) of claim 1, wherein the head portion (230) of the extractable rod (215) comprises an undercut groove in which a support rib (255*a*) of the draught-excluding brush (255) is at least partially inserted.

3. The bar handle (205) of claim 2, wherein the groove is defined by a plurality of hooks (265) branching from the head portion (230) of the extractable rod (215).

4. The bar handle (205) of claim 1, wherein the telescopic sleeve (240) comprises a plurality of tubular sections (240*a*, 240*b*, 240*c*) capable of telescopically sliding relative to each other, of which a most external section (240*c*) is fixed to the head portion (230) of the extractable rod (215) and a most internal section (240*a*) is fixed to the end of the tubular body (210).

5. The bar handle (205) of claim 4, wherein the most external section (240*c*) of the telescopic sleeve (240) comprises a projecting shelf (240*f*) which extends in a linear direction parallel to the extractable rod (215), wherein the projecting shelf (240*f*) is located on the opposite side of the most external section (240*c*) with respect to the head portion (230), and wherein the projecting shelf (240*f*) slidably engages with a longitudinal gully of the tubular body (210).

6. The bar handle (205) of claim 5, wherein the most external section (240*c*) of the telescopic sleeve (240) comprises an undercut groove in which the support rib (255*a*) of the draught-excluding brush (255) is at least partially inserted.

7. The bar handle (205) of claim 6, wherein the groove is defined by a plurality of hooks (265) branching from the most external section (240*c*) of the telescopic sleeve (240).

8. The bar handle (205) of claim 1, wherein the tubular body (210) and the telescopic sleeve (240) of the bar handle are provided with contiguous openings forming a single longitudinal slit (280) enabling insertion of an edge of the flexible screens (110, 115).

9. The bar handle (205) of claim 1, further comprising a second extractable rod (220), the head portion (235) of which projects from the second axial end of the tubular body (210).

10. A screening device (100) comprising:

a first flexible screen (110) having a first terminal edge (116) and an opposite second terminal edge (117);

a second flexible screen (115) having a first terminal edge (116) and an opposite second terminal edge (117);

a telescopic structure (130) comprising a first box element (135) and a second box element (140) fixable oppositely on two sides of an opening (105);

a first winding roller (120) bearing the first terminal edge (116) of the first flexible screen (110), wherein the first winding roller (120) is rotatably coupled and axially constrained to the first box element (135);

a second winding roller (125) bearing the first terminal edge (116) of the second flexible screen (115), wherein the second winding roller (125) is parallel to the first winding roller (120) and is rotatably coupled and axially constrained to the the second box element (140); and a bar handle (205) as claimed in claim 1, which bears the second terminal edges (117) of both the first flexible screen (110) and the second flexible screen (115), the bar handle being translatable away from and towards the winding rollers (120, 125).

11. The device of claim 10, wherein the head portion (230, 235) of the extractable rod (215, 220) of the bar handle (205) comprises a hooking element (305) hookable to an end of the telescopic structure (130).

12. The device (100) of claim 10, further comprising a pair of telescopic guide elements (295, 300) fixable along two opposite sides of the opening (105) and arranged perpendicularly with respect to the telescopic structure (130), in which opposite ends of the bar handle (205) slide.

* * * * *